US006287213B1

(12) United States Patent
Selton

(10) Patent No.: US 6,287,213 B1
(45) **Date of Patent: *Sep. 11, 2001**

(54) PUTTING TRAINING DEVICE

(76) Inventor: Daniel E. Selton, 5350 Powers Perry Rd., Atlanta, GA (US) 30327

( * ) Notice: Subject to any disclaimer, the term of this patent is extended or adjusted under 35 U.S.C. 154(b) by 0 days.

This patent is subject to a terminal disclaimer.

(21) Appl. No.: 09/454,318

(22) Filed: Dec. 3, 1999

Related U.S. Application Data

(63) Continuation-in-part of application No. 09/019,238, filed on Feb. 5, 1998, now Pat. No. 5,997,406.

(51) Int. Cl.[7] ..... A63B 69/36
(52) U.S. Cl. ..... 473/180; 473/186
(58) Field of Search ..... 473/186–192, 473/176, 171, 153, 154

(56) References Cited

U.S. PATENT DOCUMENTS 1,101,203 * 6/1914 Lueder ..... 473/180
1,544,380 * 6/1925 Edmonston ..... 473/186
1,829,283 * 10/1931 Kip ..... 473/177
2,475,763 * 7/1949 Vandal ..... 473/186
2,515,847 * 7/1950 Winkler ..... 473/171
3,909,007 * 9/1975 Wuertemburg et al. ..... 473/188
5,997,406 * 12/1999 Selton ..... 473/180

* cited by examiner

*Primary Examiner*—Mark S. Graham
(74) *Attorney, Agent, or Firm*—Troutman Sanders LLP; Gerald R. Boss

(57) ABSTRACT

A putting surface having a ball receptacle with a cup wall of a predetermined height is defined within the putting surface for receiving a moving ball. A force absorbing member extends vertically within the ball receptacle for absorbing the force of a moving ball. The force absorbing member has a first undeformed position prior to engaging the moving ball and a second deformed position when engaging the moving ball within a force absorbing zone for absorbing the force of a moving ball. Additionally, the force absorbing member is offset from the cup wall enabling a golf ball to enter the ball receptacle prior to engaging the force absorbing member.

7 Claims, 2 Drawing Sheets

PUTTING TRAINING DEVICE

This application is a continuation-in-part of U.S. patent application Ser. No. 09/019238 entitled Ball Receiver filed on Feb. 5, 1998, now U.S. Pat. No. 5,997,906.

This invention relates generally to a putting training device and more particularly to a putting training apparatus which consists of a golf ball receiver cup which is defined within a putting surface having a flat horizontal surface wherein the golf ball receiver cup includes a force absorption member.

Many people enjoy the game of golf and indeed practice their golf swing. One particular swing practiced is the putting stroke which entails hitting a golf ball with a putter over a horizontal surface into a cup. Typical portable putting cups have been designed. A common problem with portable putting cups is that they do not correctly simulate actual putting conditions. For instance, golf holes extend into the earth and accordingly have a lip which is generally horizontal. However, in order to create a golf ball receptacle on a flat surface, the walls surrounding the receptacle must be sloped upward to define a cavity. This construction requires more force to be exerted onto the golf ball in order for the golf ball to enter the golf ball receptacle than would actually be required on an actual putting green. Many such designs have been created for portable golf putting cups.

For instance, U.S. Pat. No. 5,487,545 discloses a portable golf putting cup which includes a circular base and having upwardly curved outer walls that graduate the golf ball into a circular central depression. The putting cup includes an angled shock absorbing lip and golf ball gripping teeth in addition to shock absorbing material at the bottom of a cavity. However, the shock absorbing material is horizontally located in the base of the cavity which may inadvertently bounce a ball out of the cavity.

Design Patent No. Des. 273,126 discloses a horseshoe-shaped cup. While this cup is suitable for its intended purpose, should the ball not find the target of the cup, the ball is out of play and the ball or cup must be repositioned since the horseshoe cup only has one target line which will enable the ball to roll into the cup.

Another disadvantage with such designs is that if one hits the ball with enough pace to decisively sink the putt, the golf ball may kick out of the cup because the vertical inner walls are not of sufficient height to hold the ball. To counteract this dilemma, vertical inner walls have been proposed which are high enough to hold the ball but result in either making the cup larger than realistically possible, or including inner walls which are so high that the amount of energy required to hit the ball over the graduated wall is not replicative of actual putting conditions which have a non-angled positional area which leads into a cup.

Another common design includes a long length of a carpet-like surface such as Astroturf utilized as a simulation of a putting green with a hole cut into one end of the surface. A disadvantage of this design is that the carpet-like surface is required to be of a certain thickness which is sufficient to provide a hole a certain depth to retain a golf ball. This thickness requirement provides for a more costly putting green simulator since materials are wasted merely to provide a thickened carpet in order to define a hole. Additional designs include an elevated ramp located at one end of the carpet-like surface which is utilized to provide sufficient thickness for defining a putting cup.

Accordingly, there is a need for an improved putting training device which includes a golf ball receiver that will effectively reproduce an accurate representation of a regulation putting cup.

Accordingly, it is an object of the present invention to provide an improved putting training device which includes a golf ball receiving cup that will effectively reproduce an accurate representation of a regulation putting cup by providing a horizontal putting surface of minimal height with a ball receiver;

Also, it is an object of the present invention to provide an improved putting training device which effectively reproduces an accurate representation of a regulation putting cup while minimizing the costs of materials required to reproduce a putting surface;

Furthermore, it is an object of the present invention to provide a portable putting training device which includes a force absorbing member which is located within the receiving cup for decelerating a golf ball enabling the putting cup to be of a minimal height.

SUMMARY OF THE INVENTION

The above objectives are accomplished according to the present invention by providing a putting surface having a ball receptacle having a cup wall of a predetermined height defined within the putting surface for receiving a moving ball. A force absorbing member extends vertically within the ball receptacle to a height at least equal to the cup wall for absorbing the force of a moving ball. The force absorbing member has a first undeformed position prior to engaging a moving ball and a second deformed position when engaging a moving ball within the force absorbing zone for absorbing the force of a moving ball. Additionally, the force absorbing member is offset from the cup wall enabling a golf ball to enter the ball receptacle prior to engaging the force absorbing member.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF THE PREFERRED EMBODIMENT

Figure 1:
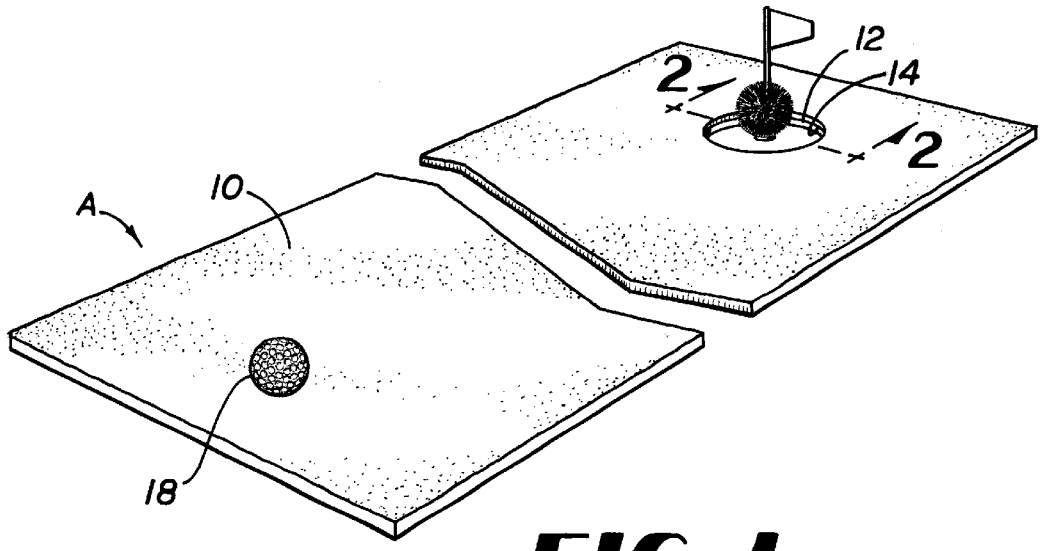
FIG. 1 is a perspective view of a putting training device according to the present invention.

As shown in FIG. 1, putting training device A enables a golfer to practice their respective putting technique. Putting training device A simulates actual putting conditions and includes a generally horizontal putting surface 10 replicating the green of a golf course. Of course, putting surface 10 may be contoured. Ball receptacle 12 is defined within putting surface 10 and includes cup wall 14 for defining a target putting cup. Putting surface 10 is of any predetermined length sufficient to provide a platform for a golfer to putt a golf ball to the ball receptacle 12. In the preferred embodiment, putting surface 10 is of a carpet-like material such as Astro-turf.

Force absorbing member 16 is disposed within ball receptacle 12 for absorbing the force of golf ball 18 when the golf ball enters ball receptacle 12. Preferably, force absorbing member 16 is centrally located within ball receptacle 12.

Figure 2:
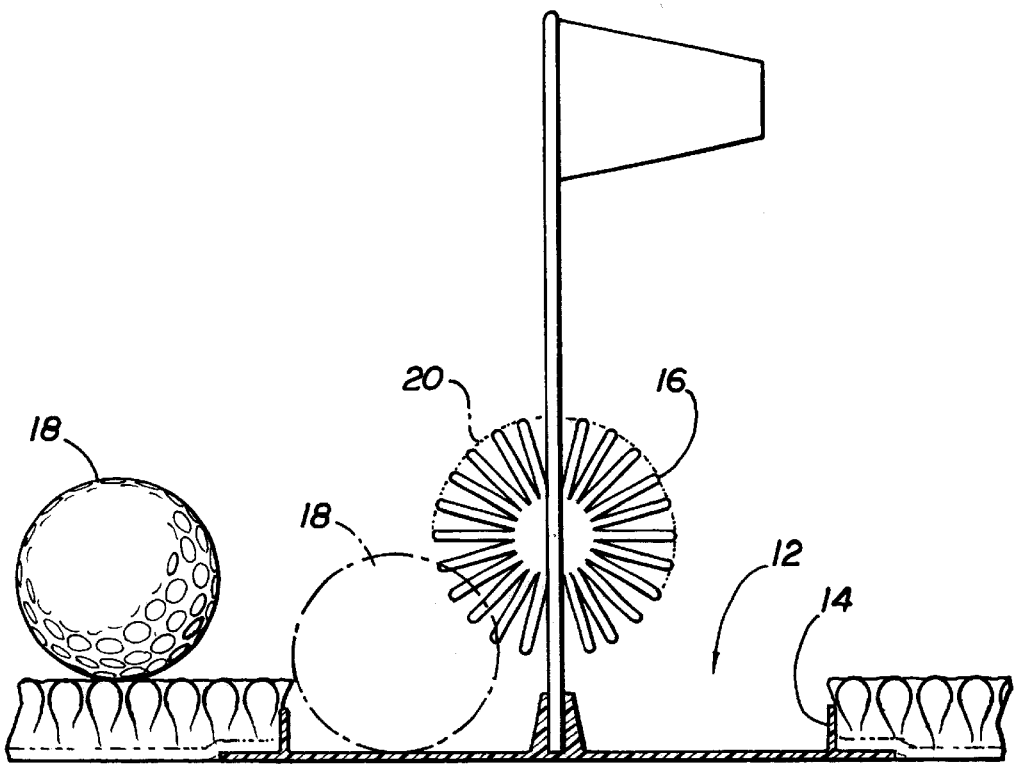
FIG. 2 is a sectional view taken along line 2—2 of FIG. 1 of a golf ball receiver according to the present invention illustrating a force absorbing member receiving a golf ball according to the present invention.
Figure 3:
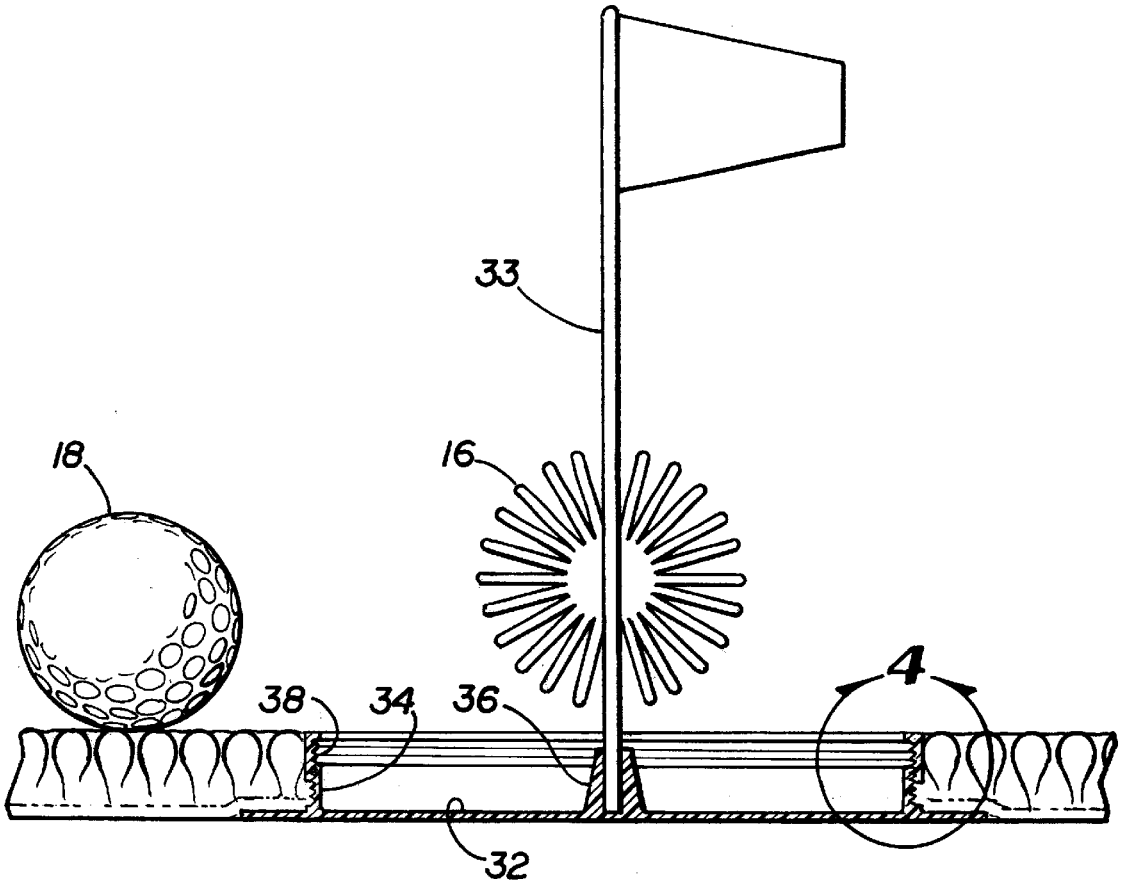
FIG. 3 is a sectional view illustrating a force absorbing member in a first undeformed position for absorbing the force of a golf ball according to the present invention.

As shown in FIGS. 1, 2, and 3, force absorbing member 16 is disposed within ball receptacle 12 for absorbing the force of golf ball 18 when it enters in ball receptacle 12. In actual putting conditions, the depth of a golf cup will overcome the general horizontal forces of a golf ball if the golf ball is not struck too hard. However, since the height of putting surface 10 and cup wall is preferably only a half an inch, the depth of ball receptacle 12 is minimal, and golf ball 18 would typically pass through ball receptacle 12. Accordingly, force absorbing member 16 absorbs forces of golfball 18 to maintain golf ball 18 within ball receptacle 12 if golf ball 18 is not struck to hard. In the preferred embodiment, force absorbing member 16 is resilient and has a first non-deformed position and deforms upon impact by golf ball 18 such that force absorbing member 16 has a second deformed position wherein at least a portion of the force of golf ball 18 has been absorbed. Preferably, force absorbing member 16 has a height wherein the center of force absorbing member is located above the center of golf ball 18 thereby also applying a downward pressure onto golf ball 18 for maintaining golf ball 18 within ball receptacle 12.

As shown in FIGS. 2 and 3, the profile of force absorbing member 16 defines a force absorbing zone 20 which is the area wherein golf ball 18 engages force absorbing member 16 for absorbing force of golf ball 18. In the preferred embodiment, force absorbing member 24 is a soft vinyl or elastomeric ball which includes resilient fingers which extend outward from a central area to define force absorption zone 20. Preferably, the resilient fingers extend radially outward from the center of ball receptacle 12 and preferably horizontally terminate at least prior to reaching cup wall 30 defining force absorption zone 20. Preferably, force absorbing member 16 is deformable from any angle within a three hundred and sixty degree angle of approach.

Figure 4:
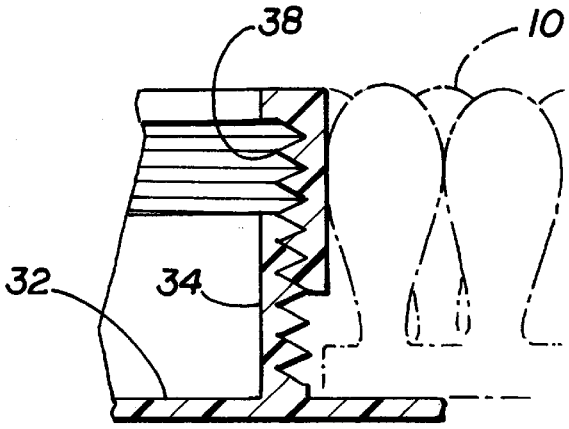
FIG. 4 is an exploded view of an exterior wall attached to a cup side wall for extending the height of the cup wall according to the present invention.

Of course, it is understood that instead of an integral putting device, separate components may be utilized to construct the invention. One such embodiment is illustrated in FIGS. 3 and 4. In FIGS. 3 and 4, ball receptacle 12 is a hole pre-cut within a putting surface and force absorbing member assembly 30 is positioned within ball receptacle 12. Force absorbing member assembly 30 includes base 32 for supporting force absorbing member 12. Preferably, force absorbing member 12 is mounted onto staff 33 and base 32 includes staff seat 36 for receiving a bottom of staff 33 maintaining force absorbing member 12 in an upright position within ball receptacle 12. In the preferred embodiment, force absorbing member assembly 30 includes base side wall 34 which extend upward from base 32 forming a periphery which abuts the interior walls of the pre-cut hole. Side wall 34 may contain grooves which interact with side wall extension member 36 for elevating the height of force absorbing member assembly with the turning of side wall extension member 36. With the side wall extension member, force absorbing member assembly may be positioned within pre-cut holes of varying heights. For instance, a hole may be cut within a piece of carpet and force absorbing member assembly 30 may be placed within the pre-cut hole and side wall extension member 36 extended to a height equal to a height of the pre-cut hole. The piece of carpet defines a putting surface for the practicing of putting. The piece of carpet with the pre-cut hole may be a single tile piece which is integrated with other tiles for creating a miniature putting green, or the piece of carpet may be of a unitary roll for placement at a designated area creating a miniature putting green.

In operation, a golf ball is putted along a target line to the center of golf ball receiver A. Golf ball 18 subsequently enters into force absorbing zone 20 and engages deformable force absorbing member 16. Force absorbing member 16 initially receives golf ball 18 and absorbs energy from the golf ball. If the golf ball has not been stricken too hard, force absorbing member 16 absorbs a sufficient amount of energy to retain golf ball 18 within ball receptacle 12. However if the golf ball has been hit too hard, force absorbing member 16 will not absorb a sufficient amount of energy to retain golf ball 26 within ball receptacle 12 and golf ball 13 will skirt out of ball receptacle 12.

Accordingly, a more advantageous design for a putting practice device may be had according to the present invention by providing a putting surface having a ball receptacle with a force absorbing member located within a golf ball receiving area for absorbing energy from the golf ball and retaining the golf ball within the golf ball receiving area if the golf ball is not hit harder than that which would make a golf ball rim out of a cup under actual putting conditions. Also, the low profile of the putting surface provides for a lower cost product having a horizontal surface for closely resembling actual putting conditions.

What is claimed is:

1. A putting training device comprising:

a putting surface;

a ball receptacle having a cup wall of a predetermined height defined within said putting surface for receiving a moving ball and defining a cup interior;

said cup wall defining a cup profile;

a staff carried within said cup interior extending upward;

a resilient force absorbing member carried by said staff extending vertically within said ball receptacle at to a height at least equal above to said cup wall for absorbing the force of a moving ball and extending outward from said staff towards a profile defined by said cup wall;

said force absorbing member having a resilient profile which defines a force absorbing zone extending away from said staff within said cup profile for engaging a moving ball for absorbing the force of said moving ball entering said ball receptacle;

said force absorbing member having a first undeformed position prior to engaging a moving ball and a second deformed position when engaging a moving ball within the force absorbing zone for absorbing the force of a moving ball; and said force absorbing member being offset from said cup wall enabling a golf ball to enter said ball receptacle prior to engaging said force absorbing member.

2. The putting training device of claim 1 wherein said force absorbing member is disposed within the center of said ball receptacle.

3. The putting training device of claim 1 wherein the height of said cup wall is not greater than an inch.

4. The putting training device of claim 1 wherein said putting surface is a carpet-like material.

5. The putting training device of claim 1 wherein said force absorbing member does not engage a bottom of said ball receptacle.

6. The putting training device of claim 1 wherein said force absorbing zone is vertically above said ball receptacle to a height at least to a height of a golf ball and terminates at least prior to reaching the profile defined by said cup wall.

7. A putting training device comprising:

a putting surface;

a ball receptacle having a cup wall of a predetermined height defined within said putting surface for receiving a moving ball;

a force absorbing member extending vertically within said ball receptacle at a height at least above said cup wall for absorbing the force of a moving;

said force absorbing member having a first undeformed position prior to engaging a moving ball and a second deformed position when engaging a moving ball within the force absorbing zone for absorbing the force of a moving ball;

said force absorbing member includes resilient fingers extending outward from a central area for engaging a moving ball for absorbing the force of a moving ball and said force absorbing member being offset from the said cup wall enabling a golf ball to enter said ball receptacle prior to engaging said force absorbing member.

* * * * *